US009745739B2

(12) United States Patent
Riepe

(10) Patent No.: US 9,745,739 B2
(45) Date of Patent: Aug. 29, 2017

(54) WALL CONSTRUCTION METHOD USING INJECTED URETHANE FOAM BETWEEN THE WALL AND AUTOCLAVED CONCRETE (AAC) BLOCKS

(71) Applicant: Frank Warner Riepe, Sudbury, MA (US)

(72) Inventor: Frank Warner Riepe, Sudbury, MA (US)

(73) Assignee: BRETON SYSTEMS LLC, Sudbury, MA (US)

( * ) Notice: Subject to any disclaimer, the term of this patent is extended or adjusted under 35 U.S.C. 154(b) by 127 days.

(21) Appl. No.: 14/544,818

(22) Filed: Feb. 20, 2015

(65) Prior Publication Data

US 2015/0240483 A1 Aug. 27, 2015

Related U.S. Application Data

(60) Provisional application No. 61/966,518, filed on Feb. 25, 2014.

(51) Int. Cl.
*E04B 1/76* (2006.01)
*E04B 1/41* (2006.01)
(Continued)

(52) U.S. Cl.
CPC ..... *E04B 1/7604* (2013.01); *E04B 1/4178* (2013.01); *E04B 2/707* (2013.01);
(Continued)

(58) Field of Classification Search
CPC ..... E04B 1/26; E04B 1/4178; E04B 1/7604; E04B 2/707; E04B 2001/2481; E04B 2001/2696; E04B 2001/7679; E04F 13/0805; E04F 13/0826; E04F 13/0803; E04F 13/081; E04F 13/0825; E04F 13/0814; E04F 13/0816; E04F 13/0821
See application file for complete search history.

(56) References Cited

U.S. PATENT DOCUMENTS 3,342,005 A * 9/1967 Rickards ..... E04F 13/0846 52/378
3,561,182 A * 2/1971 Madl, Jr. ..... E04B 2/96 52/235

(Continued)

*Primary Examiner* — James Ference
(74) *Attorney, Agent, or Firm* — Prince Lobel Tye LLP

(57) ABSTRACT

The present invention provides novel wall construction systems and materials for residential and commercial construction that incorporate grooved lightweight building material units (e.g., blocks, panels, and the like), a plurality of connection devices, a track system, and (injected) polyurethane structural foam. The wall construction system comprises building material units married to a building frame with a plurality of connection devices (e.g., clip fasteners) slidingly retained in a track system that is attached to the building's structural (e.g., load-bearing) framing. The building material units are joined to each other with a suitable binding agent. The cavity between the frame and the building material units is injected with an insulating structural polyurethane foam. The exterior of the wall is finished with a waterproof applied finish such as cementitious stucco. The interior of the wall is amenable to standard finish options.

20 Claims, 12 Drawing Sheets

(51) Int. Cl.
*E04B 2/70* (2006.01)
*E04B 1/26* (2006.01)
*E04B 1/24* (2006.01)

(52) U.S. Cl.
CPC ..... *E04B 1/26* (2013.01); *E04B 2001/2481* (2013.01); *E04B 2001/2696* (2013.01); *E04B 2001/7679* (2013.01)

(56) References Cited

U.S. PATENT DOCUMENTS 3,903,671 A * 9/1975 Cuin ..... E04F 13/0803 52/480
3,943,676 A * 3/1976 Ickes ..... E04C 2/044 52/309.11
4,223,505 A * 9/1980 Krebel ..... E04F 13/0823 52/489.2
5,265,396 A * 11/1993 Amimoto ..... E04F 13/0855 52/235
5,313,760 A * 5/1994 Tojo ..... E04F 13/0825 52/513
5,379,561 A * 1/1995 Saito ..... E04B 2/92 52/235
5,440,854 A * 8/1995 Hohmann ..... E04B 1/4178 52/379
5,469,683 A * 11/1995 McKenna ..... E06B 3/273 52/204.591
5,657,593 A * 8/1997 Eriksen ..... E04F 13/0846 248/300
5,673,529 A * 10/1997 Treister ..... E04C 2/288 52/235
5,709,058 A * 1/1998 Shaw ..... E04B 2/707 52/282.1
5,829,216 A * 11/1998 Newcomb ..... E04F 13/0807 52/167.1
5,860,257 A * 1/1999 Gerhaher ..... E04F 13/0826 52/235
5,956,910 A * 9/1999 Sommerstein ..... E04F 13/081 52/235
6,055,787 A * 5/2000 Gerhaher ..... E04F 13/0826 52/506.06
6,098,364 A * 8/2000 Liu ..... E04F 13/0855 52/235
6,170,214 B1 * 1/2001 Treister ..... E04F 13/0808 52/235
6,226,947 B1 * 5/2001 Bado ..... E04F 13/0805 52/235
6,289,646 B1 * 9/2001 Watanabe ..... E04F 13/083 52/235
6,510,667 B1 * 1/2003 Cottier ..... E04B 2/8647 52/310
6,745,527 B1 * 6/2004 Sherman ..... E04B 2/96 52/235
6,748,709 B1 * 6/2004 Sherman ..... E04B 2/96 52/235
7,204,060 B2 * 4/2007 Hunt ..... E04B 1/04 264/333
7,814,716 B2 * 10/2010 Moffatt ..... E06B 1/6015 204/213
8,341,901 B2 * 1/2013 Loyd ..... E04F 13/0803 52/235
2001/0011443 A1 * 8/2001 Watanabe ..... E04F 13/0816 52/506.05
2001/0045070 A1 * 11/2001 Hunt ..... E04B 1/04 52/284
2003/0150179 A1 * 8/2003 Moreno ..... E04F 13/0808 52/235
2005/0284100 A1 * 12/2005 Ashuah ..... E04B 2/86 52/794.1
2006/0265988 A1 * 11/2006 Fujito ..... E04F 13/0889 52/511
2007/0062151 A1 * 3/2007 Smith ..... B28B 1/503 52/782.1
2007/0151190 A1 * 7/2007 Huff ..... E04F 13/14 52/592.5
2008/0010920 A1 * 1/2008 Andersen ..... E04B 1/02 52/223.13
2008/0010922 A1 * 1/2008 Wagner ..... E04F 13/0812 52/235
2008/0016803 A1 * 1/2008 Bathon ..... E04B 5/04 52/223.6
2010/0031597 A1 * 2/2010 Baek ..... E04F 13/0805 52/489.1
2010/0050552 A1 * 3/2010 David ..... B28B 19/003 52/431
2010/0154336 A1 * 6/2010 Wagner ..... E04F 13/0805 52/235
2010/0229489 A1 * 9/2010 Riepe ..... E04B 1/4178 52/489.2
2012/0285111 A1 * 11/2012 Johnson, III ..... E04B 1/4178 52/379
2013/0205698 A1 * 8/2013 Todd ..... E04F 13/0805 52/302.1
2015/0240483 A1 * 8/2015 Riepe ..... E04B 1/7604 52/309.12

* cited by examiner

WALL CONSTRUCTION METHOD USING INJECTED URETHANE FOAM BETWEEN THE WALL AND AUTOCLAVED CONCRETE (AAC) BLOCKS

CLAIM OF PRIORITY

This patent application makes reference to, claims priority to and claims benefit from U.S. Provisional Patent Application Ser. No. 61/966,518 filed on 25 Feb. 2014. The above stated application is hereby incorporated herein by reference in its entirety.

FIELD OF THE INVENTION

The present invention provides novel wall construction systems and materials for residential and commercial construction that incorporate grooved lightweight building material units (e.g., blocks, panels, and the like), a plurality of connection devices, a track system, and (injected) polyurethane structural foam. The wall construction system comprises building material units married to a building frame with a plurality of connection devices (e.g., clip fasteners) slidingly retained in a track system that is attached to the building's structural (e.g., load-bearing) framing. The building material units are joined to each other with a suitable binding agent. The cavity between the frame and the building material units is injected with an insulating structural polyurethane foam. The exterior of the wall is finished with a waterproof applied finish such as cementitious stucco. The interior of the wall is amenable to standard finish options.

BACKGROUND OF INVENTION

There are many conventional construction systems used for residential and light commercial building projects which employ sheathing over wood and/or light-gage steel frames combined with insulation and exterior cladding components. Generally, these construction systems, while widely used, are known to have various limitations, including, allowing moisture penetration, thermal bridging, air infiltration, being subject to decay, mold and mildew, infestation, vulnerability to fire, and/or time consuming and labor intensive or expensive construction methods. In addition to the many conventional construction systems noted above other construction techniques use exterior walls composed of concrete or a lightweight concrete variant known as Autoclaved Aerated Concrete (AAC). While existing AAC construction methods can ameliorate some of these limitations seen in conventional building materials and construction methods, the construction field generally still searches for answers to a number of persistent limitations.

For example, U.S. Pat. No. 6,510,667, to Cottier et al. disclose a process for constructing a wall that includes the steps of erecting a rigid frame and attaching fiber reinforced cementitious sheets to the front and rear faces of the frame to form a void there between. This void is then filled with lightweight aggregate concrete slurry and allowed to cure. The lightweight aggregate slurry to fill the void formed between the sheets may be of conventional composition and can incorporate pulverized scrap polystyrene foam material ("grist") or expanded polystyrene beads. The cementitious sheets may comprise an autoclaved cured reaction product of metakaolin, Portland cement, crystalline siliceous material and water. U.S. Pat. No. 6,532,710, to Terry discloses a solid monolithic concrete insulated wall system comprising 100% concrete construction on interior walls and exterior walls of buildings. Building materials consist of conventional concrete which is poured inside a cavity between two stay in place forming walls completely around the perimeter of the building. A highly cellular, lightweight material from quartzite, lime and water, known as Autoclaved Aerated Concrete (AAC) is used as a "stay in place" forming system of the exterior walls and interior walls. Two AAC walls run the entire perimeter of the respective building. The two walls are designed to form a cavity in which the concrete is poured. Anchor bolts, which are bolted deep into each side of the walls, hang into the cavity. For insulation purposes two sheets of foil backed insulation are attached to the inside of the outside wall by the anchor bolts. U.S. Pat. No. 7,204,060, to Hunt discloses a system for manufacturing structures using AAC. The first step is construction of the wall system, which comprises a first course of elongated AAC base blocks for placement on a pre-built foundation. U.S. Pat. No. 3,943,676, to Ickes discloses a modular building wall unit comprising a hard foam layer and a concrete layer intimately bonded to each other along an interface between the layers. A reinforcing wire mesh matt is embedded in the hard foam layer and reaches with anchoring elements into the concrete layer which may also have embedded therein a further wire mesh matt. U.S. Published Patent Application No. 2008/0016803, to Bathon et al. disclose a wood concrete composite system that comprises a wood construction component, an intermediate layer and a concrete construction unit. A single intermediate layer consists, for example, of a plastic foil, an impregnated paper, a bitumen pasteboard, a plastic insulating layer, a mineral insulating layer, an organic insulation material, a regenerating insulating material and up-poured and/or applied materials, which tie and/or harden at a later time, e.g., tar, adhesive, plastic mixtures. The range of types of concrete suitable for the concrete construction unit includes aerated concrete. U.S. Published Patent Application No. 2007/0062151, to Smith discloses a composite building panel which includes a frame and a concrete slab made of aerated concrete. Fastened to the frame members is a reinforcing layer. The frame is oriented towards the interior side of the structure and the concrete slab is oriented towards the exterior side of the structure. The exposed frame provides cavities for the installation of plumbing, electrical wiring and insulation. U.S. Published Patent Application No. 2008/0010920, to Andersen discloses a method of building construction wherein blocks and panels made from autoclaved aerated concrete are used as structural elements, including insulated panels having a rigid polyurethane/polyiscocyanurate foam core, are attached to structural elements via metal anchoring clips. U.S. Published Patent Application No. 2005/0284100, to Ashuah et al. disclose a wall section having a sandwich like structure, which includes an external vertical panel and an internal vertical panel spaced apart in a parallel relationship, further including a vertical insulating layer. The external panel may be constructed of building blocks made of concrete or AAC. The internal panel may be constructed of wood panel. Between the panels there is a space, "core" which includes a vertical layer of concrete. The outer surface of the external panel is covered with a coating layer constructed of materials selected from among a group comprising of stone, marble, mortar, wood, aluminum, glass, porcelain and ceramics. U.S. Published Patent Application No. 2001/0045070, to Hunt, discloses autoclaved aerated concrete panels, and method of making and using such panels, specifically for the construction of residential homes. U.S. Pat. No. 8,240,103, to Riepe, discloses a composite construction system and a method of constructing a wall that incorporates AAC blocks married to a building frame with a plurality of connection devices. The AAC blocks are joined one to the next with thin-bed mortar. The cavity between the frame and the AAC blocks is injected with structural insulating foam such that a layer (or a fill) of foam is formed in place once expanded and cured. And the exterior of the AAC walls are finished with waterproof cementitious stucco finish. Riepe describes a plurality of connection devices having projections (i.e., stubs) that engage grooves in the tops and bottoms of the AAC blocks. Individual connection devices are attached directly and non-slidingly fixed (e.g., with screws) to the exterior surface of the building's framing in level horizontally orientated rows corresponding to the grooves in the tops and bottoms of the AAC blocks. Each member of the building's framing may have from 1, 2, 3, 5, 10, 20, 50, or more, connection devices fixedly attached thereto. The U.S. Pat. No. 8,240,103 patent is incorporated by reference herein in its entirety.

There have been a number of advances in the field of construction materials and construction systems as demonstrated by use of AAC blocks and connection devices described in U.S. Pat. No. 8,240,103 patent. Nevertheless, what is needed are wall construction systems and materials suitable for residential, commercial, and other construction projects that substantially ameliorate at least some of the disadvantages of existing conventional and/or AAC construction techniques such as reducing labor requirements during construction and/or other installation requirements. It is contemplated that labor savings during construction and installation will reduce total costs and allow for greater building efficiencies to be realized.

SUMMARY OF THE INVENTION

The present invention provides novel wall construction systems and materials for residential and commercial construction that incorporate grooved lightweight building material units (e.g., blocks, panels, and the like), a plurality of connection devices, a track system, and (injected) polyurethane structural foam. The wall construction system comprises building material units married to a building frame with a plurality of connection devices (e.g., clip fasteners) slidingly retained in a track system that is attached to the building's structural (e.g., load-bearing) framing. The building material units are joined to each other with a suitable binding agent. The cavity between the frame and the building material units is injected with an insulating structural polyurethane foam. The exterior of the wall is finished with a waterproof applied finish such as cementitious stucco. The interior of the wall is amenable to standard finish options.

In particularly preferred embodiments, the building systems and methods of the present invention incorporate and make use of lightweight building material units comprising units of Autoclaved Aerated Concrete (AAC). AAC does not burn and 4" of AAC block material has received a 4-hour fire rating. The AAC material units can be in the form of blocks, panels, or any suitable finished dimensional AAC product.

AAC is a structural product composed of a mixture of cement, lime, water, and sand and aluminum powder. To manufacture AAC, cement is mixed, with lime, silica sand, water, and aluminum powder and poured into a mold. Other materials can be added or substituted into the AAC mixture including, but not limited to, pulverized fuel ash. The reaction between aluminum and cement causes microscopic hydrogen bubbles to form, expanding the cement to about five times its original volume to fill a preselected mold. After evaporation of the hydrogen, the aerated concrete is cut to size and steam-cured in an autoclave. The finished products can be cut and machined into precisely dimensioned units and drilled through or grooved as specified. At the construction site, AAC units (e.g., blocks or panels) can be joined with thin-bed mortar.

As an integrated building system, the present invention comprising walls constructed of AAC blocks provide many benefits to residential and commercial buildings, including, but not limited to, providing high thermal resistance, preventing thermal bridging, providing increasing protection against water damage, vapor damage, fire, decay, mold or mildew damage, frost damage and insect damage, being impact resistance, reducing the need for painting or maintenance; the absence of any toxic compounds; providing a greater acoustical barrier and providing stronger shear strength. In addition, the building system is lightweight for transport and construction and compatible with existing plumbing, wiring, roofing, exterior stuccos and interior finishes commonly used.

While in some preferred embodiments the present construction systems are optimized for constructing walls made of AAC blocks, the clip fasteners, track system, and shelf angle components of the present invention are not limited to applicability solely with AAC construction materials. For example, in certain other embodiments, additional and/or substitute lightweight building material units with suitable properties for use with the present invention are specifically contemplated for use in wall construction (e.g., clay honeycomb blocks, bio-composite blocks comprising recycled or sustainable adjunct materials such as hemp, wood chips, fuel fly ash, recycled aggregate and the like). In still further embodiments, concrete blocks with various additives and/or fillers and the like that otherwise have one or more of the desirable properties mentioned of AAC construction materials are contemplated.

The present invention provides certain improvements over existing AAC wall construction systems and components. Notably, recent U.S. Pat. No. 8,240,103 described a composite construction system and a method of constructing walls that incorporates AAC blocks married to a building frame with a plurality of connection device. The U.S. Pat. No. 8,240,103 advanced the state of the construction arts by introducing the fixed clip system described therein. The present invention describes an improvement upon U.S. Pat. No. 8,240,103 by providing a track system that slidingly retains a plurality of connection devices. The systems and methods of the present invention require comparatively less labor and installation time than existing AAC construction systems and provide greater wall assembly flexibility.

In one preferred embodiment, the present invention provides novel building materials and wall construction methods that incorporate a plurality of stacked AAC blocks that are attached to the building's framing (e.g., wood studs, metal studs, concrete, and the like) by a plurality of connection devices (e.g., clip fasteners) which engage one or more grooves in the surface of the blocks. Preferably, the AAC blocks have one or more continuous grooves in either/both their top and bottom surfaces; however, intermittently spaced grooves in either/both of these surfaces are contemplated as well. Grooves in the AAC blocks can be centered or off-centered on a particular surface. In preferred embodiments, a groove on one surface (e.g., the top surface) of an AAC block has a corresponding groove in the same transactional plane on the opposing surface of the block (e.g., the bottom surface). The lightweight building construction units employed in the compositions and methods of the present invention can comprise one or more grooves in 1 to 2 to 3 to 4 to 5 or to 6 surface(s) of a respective unit.

In another embodiment of the invention, the top and bottom grooves of the lightweight building material units (e.g., AAC blocks) comprise a space of about ½" deep by about ¼" wide, and more preferably, by about ⅛" wide.

In a preferred embodiment, the connection devices comprise clip fasteners. A plurality of clip fasteners are slidingly retained in a track system that is horizontally attached to the exterior surface (face) of the building's load-bearing framing (e.g., wood or metals studs and the like). A plurality of tracks are attached to the exterior surface of the building's framing. Track sections are placed end-to-end in succession such that the respective sections form a continuous integrated track of the desired length on the exterior surface of the building's framing (e.g., level relative the building foundation). It should be noted, however, that the wall construction methods comprising the clip fasteners and sections of track system of the present invention are equally applicable to the construction of interior walls where the track sections are additionally, or in substitution thereof, attached to the interior surface of the building's framing.

The tracks are optimized in cross-section to slidingly retain a number of clip fasteners along their length. Once the clip fasteners are positioned in a track section, they are orthogonally disposed between the track and the AAC blocks. The AAC blocks stand off from the building's framing by the combined length of the clip fasteners and tracks system section(s). This forms a first void between the interior surface of the AAC blocks and the exterior surface of the building's framing. A second void is formed on account of the width of the load-bearing building framing members (e.g., dimensional 2"×4" or 2"×6" wood studs, and the like, and/or metal studs) as measured from the interior surface of the building framing members to the exterior surface of the members. The first and second voids, respectively, form a cavity that is injected with a structural insulating foam. Successive rows (i.e., courses) of AAC blocks are joined with thin-bed mortar. Successive rows of ACC blocks form a wall surface the exterior of which is preferably covered with a waterproof finish such as cementitious stucco finish. In a preferred embodiment, the bottom row of AAC blocks are grooved on the bottom surface and this groove is engaged by a shelf angle mounted to the base of the wall.

In preferred embodiments, the invention comprises a composite construction system coupling a frame and AAC blocks, the system comprising: a load-bearing frame and at least a single intermediate layer of injected polyurethane foam, an AAC block unit wherein one side of the block faces towards the load-bearing frame (e.g., an interior ACC block surface), and further wherein the at least single intermediate layer of polyurethane foam is interposed between the load-bearing frame and the AAC blocks so as to couple the load-bearing frame and the AAC blocks; and a plurality of connection devices (clip fasteners) slidingly retained on a track between the load-bearing frame and the AAC concrete construction unit.

The construction systems and materials of the present invention are compatible with wood framing, heavy timber framing, steel framing or heavy steel frame with steel stud infill. In one embodiment of the present invention, the load-bearing frame is made out of at least one of a group of materials consisting of solid wood, timber materials, engineered wood products, wood composite materials, steel, aluminum, concrete, plastics and other composites, recycled and sustainable materials, or other suitable materials. In one embodiment of the present invention, the load-bearing frame comprises a material selected from a group consisting of wood and metal. In preferred embodiments, the load-bearing frame is otherwise non-sheathed.

In a further embodiment, each of the plurality of connection devices (e.g., clip fasteners) comprise at least a first end (a first terminus) that is inserted into a track system that is attached to the load-bearing frame and second end (a second terminus) that terminates in at least one attachment surface, and more preferably two attachment surfaces (i.e., interlock stub(s)). The attachment surfaces are optimized for engaging a groove in a lightweight building material unit such as an AAC block. More particularly, in some preferred embodiments, the plurality of connection devices comprises clip fasteners. In preferred embodiments, the first terminus of each respective clip fastener comprises two compressible legs comprising a roughly "Y" shaped cross section. In preferred embodiments, each of the respective leg sections terminate in a hook shaped (e.g., semicircular) element. The ends of the legs thus form a gap (space) in between one another when not being compressed. In one preferred embodiment, the gap when the legs are not being compressed measured at the widest point on the inside surfaces of the leg is from about ⅛" to about 6", more preferably from about ¼" to about 3", and more preferably from about ¾" to about 1¼". In still other embodiments, the gap is about 1".

In particularly preferred embodiments, the "Y" shaped legs can be compressed by the wall system installer (e.g.; a mason) by simply using finger strength such that the legs are pushed together relative to the gap and the central axis of the clip fastener. Once compressed, the legs of the clip fastener are inserted into the channel of the track section and the compression force is released such that the legs revert back into their approximate pre-compression shape and orientation within the channel of the section of track system thereby creating a slight tension between the legs and the track section. The cross section of the lengths of track section are optimized to slidingly retain the clip fasteners inserted therein. The second terminus of each respective clip fastener comprises a termination having a roughly "T" shaped cross section. The "T" shaped section comprises two projections (i.e., stubs) orientated at right angles relative the main body of the clip fastener. The interlock stubs comprising the T shaped end of the clip fasteners are optimized to engage corresponding grooves in one or more surfaces of the lightweight building material units (e.g., AAC blocks). In a preferred embodiment, the stubs of the clip fastener components comprise protrusions of about ½" long and about ¼" wide. It should be noted, however, that different stub protrusion dimensions (and groove dimensions) are possible within common variations in view of the desire to achieve sufficient engagement of the grooves in the lightweight building material units by the clip's stubs.

In a further embodiment, the plurality of connection devices (e.g., clip fasteners) comprise a material selected from a group consisting of suitable metals (e.g., aluminum, steel, and the like), plastics, and composite materials. The connection devices (e.g., clip fasteners) should be constructed from a material, or combination of materials, that provide a sufficient level of elasticity after repeated deformations such that the device is able to return to its original shape. In a preferred embodiment, the clip fasteners are made of plastic, and more preferably, of an ABS plastic, although other materials such as suitable metals and composites as possible.

In preferred embodiments, the track system of the present invention provides a race for receiving and slidingly retaining a plurality of clip fasteners. While not being limited to any particular configuration, preferably the track is roughly "C" shaped in cross section. The main body of the track system preferably has at both top and bottom edges a short protrusion at a right angle therefrom. These top edge and bottom edge protrusions terminate in two opposing inwardly turned bevels/ridges that positively engage a correspondingly shaped hook (e.g., semicircular) element found at the terminus of each of the respective "Y" shaped legs sections at the first end of clip fastener. In some embodiments, the two opposing inwardly turned bevels are semicircular in section. The leg section of the clip fastener when compressed, inserted, and subsequently released, engage the opposing channel bevels at the top and bottom edges of the U shaped track system. Within design variations, any track section cross section and leg section of the clip fastener cross section that provide sufficient tension and slide ability are contemplated.

In certain embodiments, the track sections comprise a material selected from a group consisting of suitable metals (e.g., aluminum, steel, and the like), plastics, and composite materials. The track sections should be constructed from a material, or combination of materials, that provide a sufficient level of elasticity after repeated deformations such that the device is able to return to its original shape.

Individual track sections are not limited to being any particular length. Indeed, the length of respective track sections is directed by manufacturing, transportation and storage, and on site handling and installation considerations. In preferred embodiments, a number of track sections are attached to the exterior surface of the building's load-bearing frame using a plurality of regularly, or irregularly, spaced attachment devices including, but not limited to, one or more screws, bolts, nails, rivets, adhesives, and the like. In instances where the attachment devices traverse the track sections, it is contemplated that track sections are either premade or modified (e.g., drilled, punched, or cut) on site to have a sufficient number of holes to receive the attachment devices. In one embodiment, track sections are secured to the load-bearing framing with a plurality of screws. In particularly preferred embodiments, the screws comprise self-drilling peer-driven screws. In a preferred embodiment, a plurality of track system sections are attached to one or more track support sections (e.g., girts) that are attached in a horizontally disposed (relative to the building's foundation) succession to the exterior surface of the load-bearing framing. The plurality of track support sections can be attached to the exterior surface of the load-bearing framing by any conventional attachment device including, but not limited to, screws, bolts, nails, rivets, adhesives, and the like. In preferred embodiments, the plurality of track support sections are attached with nails. In another preferred embodiment, the plurality of track support sections are attached with screws.

In a further embodiment, the track support sections comprises a material selected from a group consisting of suitable wood, wood composites, metals (e.g., aluminum, steel, and the like), plastics, such as ABS, pultruded fiberglass, and composite materials. In a preferred embodiment, the track support sections comprise wood or wood composites. Wood and wood composites materials suitable for track support sections include, but are not limited to, 1"×3", 1"×4", 1"×5", 1"×6", 2"×4", 2"×6", 2"×8", 4"×4", 4"×6", and the like, as well as dimensional sizes and metric equivalents thereof. The horizontal track support sections are referred to as "girts."

In still other embodiments, the construction materials, and accompanying construction methods, of the present invention provide and employ one-piece integrated track supports sections (girts) with track system sections. In still other embodiments, the construction materials, and accompanying constructions methods, of present invention provide one or more horizontal track supports sections (girts) attached to one or a plurality of track system sections prior to installation of the track supports onto the load-bearing framing.

In preferred embodiments, the first course of the lightweight building material units (e.g., AAC blocks) installed is engaged by a one or more of a plurality of shelf angles attached to the bottom portion of the load-bearing faming members. In preferred embodiments, the shelf angle comprises a roughly "L" shape cross section such that the shelf angle is defined as a right angle having a vertical leg and horizontal leg wherein the vertical leg is attached to the load-bearing faming and the horizontal leg terminates in a vertical protrusion (e.g., a continuous or discontinuous interlock stub). In another embodiment of the invention, the vertical leg of the shelf angles comprises a wide base that narrows as it extends upwards to form an inclined surface facing away from the load-bearing frame. In particularly preferred embodiments, the stub portion of the shelf angle engage the bottom groove of the lightweight building material units placed on the angle sections. A groove in the bottom surface of each of the first course of AAC blocks in a wall section is engaged by the self-angle.

In a further embodiment, the shelf angles comprise a material selected from a group consisting of suitable metals (e.g., aluminum, steel, and the like), plastics, such as ABS plastic, pultruded fiberglass, and composite materials. In a preferred embodiment, the shelf angles comprise pultruded fiberglass and/or fiber reinforced plastics. In preferred embodiments, a plurality of sections of shelf angle are attached to the exterior surface of the building's load-bearing framing using a plurality of regularly, or irregularly, spaced attachment devices comprising, but not limited to, one or more screws, bolts, nails, rivets, adhesives, and the like. In instances where the attachment devices traverse the shelf angles, it is contemplated that the shelf angles are either premade or modified on site with a sufficient number of holes to receive the attachment devices. In a preferred embodiment, sections of shelf angle are secured to the load-bearing framing with a plurality of screws. In particularly preferred embodiments, the screws comprise self-drilling peer-driven screws.

In another embodiment of the invention, the methods further comprise the step of placing leveling grout into any gaps underneath the shelf angles.

In a still further embodiment of the present invention, the methods further comprise the step of attaching the vertical legs of the plurality of shelf angles to the load-bearing frame preferably in a horizontal orientation; nevertheless, one or more shelf angle sections can also be attached vertically to the load-bearing frame.

Additionally, preferred clip fasteners, sections of track system, and sections of shelf angle, comprise materials exhibiting one or more desirable properties including, but not limited to, having/being sufficiently resistant to chemical degradation, fire resistant, mold, mildew, resistant to insect and rodent damage, high impact resistance, high shear strength, sufficient workability over a wide range of ambient temperatures, minimal to no thermal bridging, and/or being lightweight. The particular dimensions of the track system, clip fasteners, and shelf angles are not critical to successfully deploying the building systems and construction materials so long as the desirable wall properties are achieved in regard to wall strength, rigidity, ductility, thermal insulation, fire resistance, insect, rot, mold, and mildew damage resistance, waterproofing, and the like, in addition to sufficient sliding retention of the clip fasteners by the track system.

In one embodiment of the present invention, the load-bearing frame and the AAC concrete construction are erected on a concrete foundation. The present invention is not limited however to the choice of base or foundation selected for use with the wall construction methods and building material systems, as the present invention can be adapted for use with any standard construction technique (e.g., slab foundations, foundation walls, and the like). In a further embodiment of the present invention, the foundation comprises a concrete foundation. In another embodiment of the invention, the construction methods further comprise the step of anchoring the first plurality of connection devices and/or shelf angle sections to the foundation.

In one embodiment of the invention, the methods further comprise the step of adding an adhesive to the top and/or bottom grooves of the AAC blocks before placing them on the wall. Suitable adhesives include, but are not limited to, thin-bed mortar, and gun-grade adhesives.

In another embodiment of the present invention, the distance between the exterior surface of the load-bearing frame and the inside surface of the AAC concrete construction comprises from about 1" to about 10" or more, preferably, from about 1½" to about 8", more preferably, from about 1½" to about 6", and even more preferably, from about 1½" to about 4".

In preferred embodiments of the invention, the cavity created using the lightweight building material units (e.g., AAC blocks), connection devices (e.g., clip fasteners), sections of track system, and sections of shelf angle of the present invention is partially filled with an expanding structural polyurethane foam. In another embodiment of the invention, a single intermediate layer (fill) of polyurethane foam comprises a width of from about 1" to about 10", or from about 2" to about 10" or more, more preferably, from about 2" to about 8", and even more preferably, from about 3½" to about 6".

Suitable injectable polyurethane foams comprise polyurethane foams having a water-vapor permeability of about less than one perm, and thermal performance of about R-5 (or more) per inch or more, and/or a total integrated wall system value of about R-40. Suitable polyurethane foams include, but are limited to, closed-cell polyurethane foams having about two-pound density. The present invention is not limited to any particular polyurethane and/or polyurethane structural foams however. Indeed, foams suitable for use with the present invention comprises at least one, and more preferably several, of the following suitable characteristics: impermeability (i.e., from about 100 to about 90 to about 80 to about 70% impermeability) to vapors and water, thermal barrier properties, resistance to/prevention of thermal bridging, acoustic deadening/proofing properties, shock absorbance properties, zero (or acceptably low) outgassing of toxic and/or noxious fumes, fire resistance and, importantly, the requisite adhesive qualities.

In a further embodiment of the invention, an exterior finish can applied to the exterior of the AAC concrete construction. In one embodiment of the invention, the exterior finish comprises a cementitious stucco finish. In still another embodiment, the cementitious stucco finish comprises a waterproof stucco finish modified or otherwise.

In another embodiment of the invention, any standard interior finish can be applied to the interior surface of the load-bearing frame (i.e., the occupied space). In one embodiment of the invention, the interior finish comprises any standard interior wall finishing materials and/or techniques such as dry wall including, but not limited to, drywall, plasterboard, wallboard, gypsum board, plaster, wood and composite wood product paneling, concrete panels, tile, and the like.

The present invention provides many advantages Compared to existing construction systems. In certain embodiments, the compositions and methods of the present invention comprise an improvement to U.S. Pat. No. 8,240,103.

In a composite construction system having: a load-bearing (non-sheathed) frame and a lightweight concrete construction unit, and an internal cavity (of at least 1" width) between the load-bearing frame and the lightweight construction unit, wherein one side of the lightweight concrete construction unit faces towards the load-bearing (non-sheathed) frame, further wherein the load-bearing (non-sheathed) frame is adhered to the lightweight concrete construction unit using at least a single layer of (injected) polyurethane foam interposed between the load-bearing (non-sheathed) frame and the lightweight concrete completely filling the internal cavity, wherein the layer of polyurethane foam prevents thermal bridging between the load-bearing (non-sheathed) frame and the lightweight concrete; and a plurality connection devices between the load-bearing (non-sheathed) frame and the lightweight concrete construction unit, wherein the improvement comprises the plurality of connection devices slidingly retained in a section of track system.

The invention also comprises a method of constructing a wall, the method comprising the steps of: a) erecting a load-bearing frame having an interior facing surface and an exterior facing surface on a support such as a conventional foundation or slab; b) attaching a first plurality of shelf angle sections (on top of the foundation) on the exterior surface of the load-bearing frame, wherein each of the shelf angle sections comprises an upwardly projecting interlock stub, further wherein each of the shelf angle sections is placed such that the interlock stub extends in an upward direction from the foundation distal from the load-bearing frame; c) placing a first plurality of lightweight building material units (e.g., AAC blocks) on top of the shelf angle sections exterior to the load-bearing frame by inserting the interlock stubs of the placed first plurality shelf angle sections into a bottom groove on each lightweight building material unit, such that a vertical internal cavity is created between the load-bearing frame and the first plurality of lightweight building material units, wherein each lightweight building material unit further comprises a top groove, further wherein the plurality of lightweight building material units have an interior surface facing the load-bearing frame and an opposite exterior surface; d) attaching a first plurality of track support sections on the exterior surface of the exterior surface of the load-bearing frame; e) attaching a first plurality of track system sections to the first plurality of track support sections; f) inserting a first plurality of connection devices (e.g., clip fasteners) into the first plurality of track system sections such that the first plurality of connection devices is slidingly retained in the first plurality of track system sections wherein each of the first plurality of connection devices comprises a downward interlock stub and an upward interlock stub, further wherein each of the first plurality of connection devices is placed such that the downward interlock stub is inserted into the top groove of the first plurality lightweight building material units; g) applying a layer of adhesive (e.g., thin-bed mortar) to the top surface of the first plurality lightweight building material units; h) placing a second plurality of lightweight building units directly on top of the first plurality of lightweight building material units wherein each of the units has a top groove and bottom groove, further wherein the top interlock stub of the first plurality of connection is inserted into the bottom groove of the second plurality of lightweight building material units; i) repeating steps (d) through (h) until the desired exterior wall height is achieved and vertical internal cavity separating the lightweight building material units and the load-bearing frame is achieved; j) applying an exterior finish (e.g., two-coat cementitious stucco) to the exterior surface of the lightweight building material units; k) injecting a polyurethane foam into the vertical internal cavity and allowing said polyurethane foam to expand and cure; and l) applying an interior finish to the interior surface of the load-bearing frame. It is to be understood that the exact order of steps outlined herein may be rearranged or substituted so long as the desired wall is achieved.

The invention also comprises a method of constructing a wall, the method comprising the steps of: a) erecting a load-bearing frame having an interior facing surface and an exterior facing surface on a support such as a conventional foundation or slab; b) attaching a first plurality of shelf angle sections on top of the foundation on the exterior surface of the load-bearing frame, wherein each of the shelf angle sections comprises an upwardly projecting interlock stub, further wherein each of the shelf angle sections is placed such that the interlock stub extends in an upward direction from the foundation distal from the load-bearing frame; c) placing a first plurality of AAC blocks on top of the shelf angle sections exterior to the load-bearing frame by inserting the interlock stubs of the placed first plurality shelf angle sections into a bottom groove on each lightweight building material unit, such that a vertical internal cavity is created between the load-bearing frame and the first plurality of AAC blocks, wherein each lightweight building material unit further comprises a top groove, further wherein the plurality of AAC blocks have an interior facing surface facing the load-bearing frame and an opposite exterior facing surface; d) attaching a first plurality of track support sections (e.g., girts) on the exterior surface of the exterior surface of the load-bearing frame; e) attaching a first plurality of track system sections to the first plurality of track support sections; f) inserting a first plurality of clip fasteners into the first plurality of track system sections such that the first plurality of clip fasteners is slidingly retained in the first plurality of track system sections wherein each of the first plurality of clip fasteners comprise a downward interlock stub and an upward interlock stub, further wherein each of the first plurality of clip fasteners is placed such that the downward interlock stub is inserted into the top groove of the first plurality AAC blocks; g) applying a layer of adhesive (e.g., thin-bed mortar) to the top surface of the first plurality AAC blocks; h) placing a second plurality of AAC blocks directly on top of the first plurality of AAC blocks wherein each of the blocks has a top groove and bottom groove, further wherein the top interlock stub of the first plurality of connection is inserted into the bottom groove of the second plurality of AAC blocks; i) repeating steps (d) through (h) until the desired exterior wall height is achieved and vertical internal cavity separating the AAC blocks and the load-bearing frame is achieved; j) applying an exterior finish to the exterior surface of the AAC blocks; k) injecting a polyurethane foam into the vertical internal cavity and allowing said polyurethane foam to expand and cure; and l) applying an interior finish to the interior surface of the load-bearing frame.

It will be understood by those skilled in the art that junctions between dissimilar materials (and sometime similar materials) and any protrusions through the finished walls (e.g., doors, windows, piping, ducts, structural members, etc.) may benefit from optional inclusion of one or more suitable flashings, counter flashings, drip caps, flexible sealants, caulks (e.g., siliconized caulks), mortars, adhesives, and the like, to limit water and/or vapor infiltration and/or to provide stability.

A number of standard testing methods are known in the structural engineering and construction related arts suitable for quantifying the desirable characteristics of the integrated building systems and compositions (or the components thereof) of the present invention such, but not limited to, levels of the water and vapor impermeability, thermal barrier properties, resistance to/prevention of thermal bridging, acoustic deadening/proofing properties (e.g., wherein an STC value is about 41 and/or an OITC value is about 33), shock absorbance, shear strength, ductility for seismic resistance, adhesive qualities, fire resistance/proofing, zero (or acceptably low) outgassing of toxic and/or noxious gases, resistance to rot, mold, insect, and animal damage, and the like. Those skilled in the art will be able to select the desired properties of the various components of the wall construction systems and materials for respective residential and/or commercial construction projects in view of local, state, national, and/or federal building codes, and/or conventions observed in a particular area. In preferred embodiments, the wall construction systems and materials are tested in accordance with, and prove to be suitable for the intended purpose under one or more American Society for Testing and Materials ("ASTM") tests (e.g., ASTM C 518, ASTM D1622, ASTM D 2126, ASTM E84, ASTM E90, ASTM E96, ASTM E283, ASTM E330, ASTM E331, ASTM E564, and/or TAS 201, TAS 203 and the like).

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components or construction steps set forth in the following descriptions or illustrated in the drawings. The invention is capable of other embodiments and of being practiced and carried out in various ways. It is understood that the phraseology and terminology employed herein are for the purpose of the description and should not be regarded as limiting.

For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

DETAILED DESCRIPTION

While several variations of the present invention have been illustrated by way of example in preferred or particular embodiments, it is apparent that further embodiments could be developed within the spirit and scope of the present invention, or the inventive concept thereof.

The invention comprises a novel wall system for residential and light commercial construction that incorporates lightweight construction material units such as AAC blocks. This wall system comprises an exterior wall composed of AAC blocks married to an interior wood or metal load-bearing (structural) framing. The AAC blocks would be anchored to the framing using novel construction clips. Furthermore, a cavity or space between the framing and the interior surface of the exterior wall comprising AAC blocks is injected with structural polyurethane foam insulation to adhere the framing and the walls together and to provide insulation, air-sealing, and vapor-proofing. The exterior of the AAC walls further comprises an exterior cementitious stucco finish that is waterproof. The interior of the load-bearing framing receives a typical interior finish.

FIGS. 1-7 generally illustrate isometric, plan, and section views of certain typical embodiments of the construction materials and construction methods of the present invention for constructing a novel wall system. In these embodiments, as is shown in the representative Figures a load-bearing frame (non-sheathed) 2 of wood and/or metal (e.g., steel) is erected with wind bracing 3 (See, FIG. 1B) (e.g., steel wind bracing) on a conventional concrete foundation 1. No sheathing is applied.

Figure 1A:
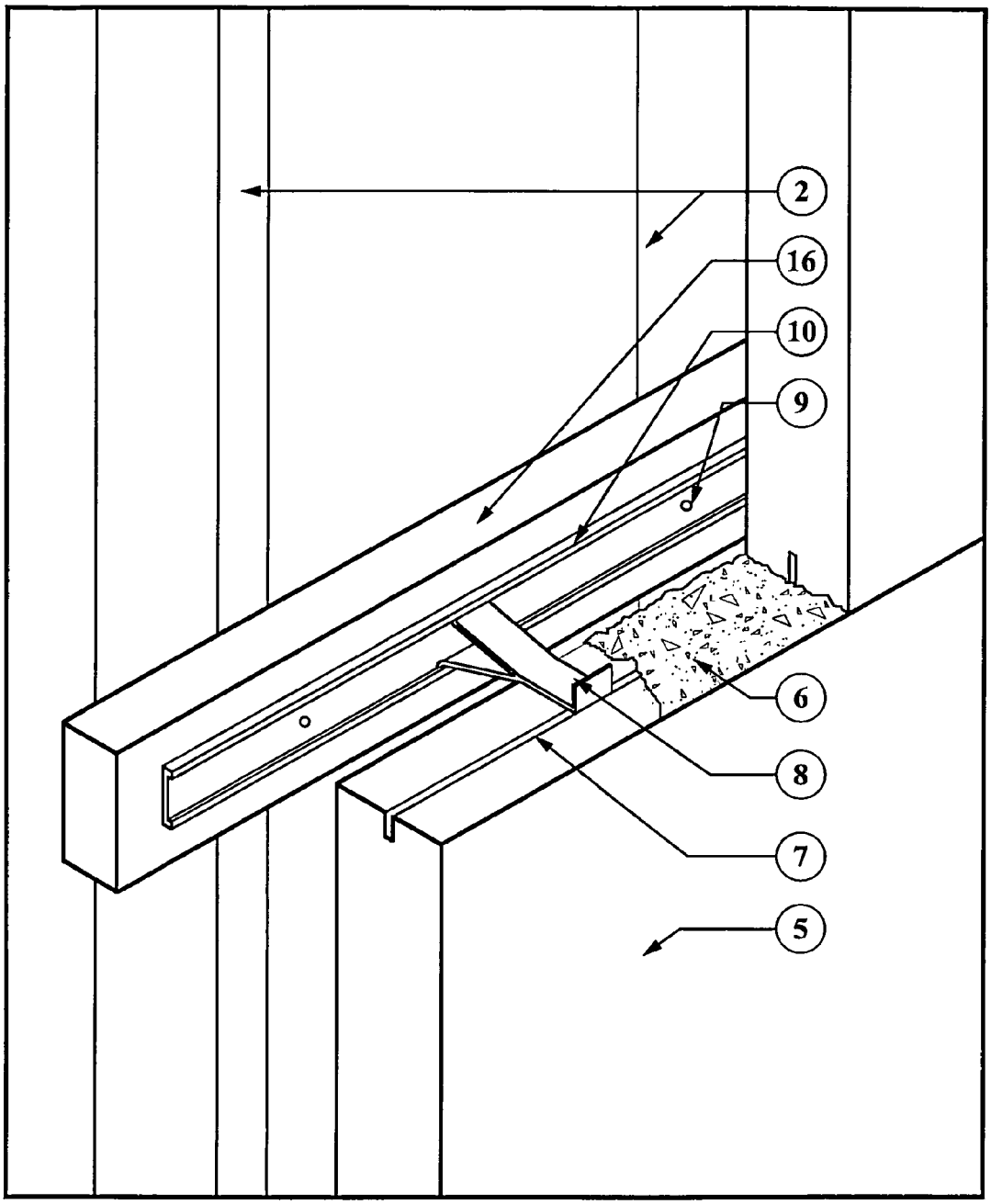
FIG. 1A illustrates an isometric view of a typical section of the wall system assembly.
Figure 1B:
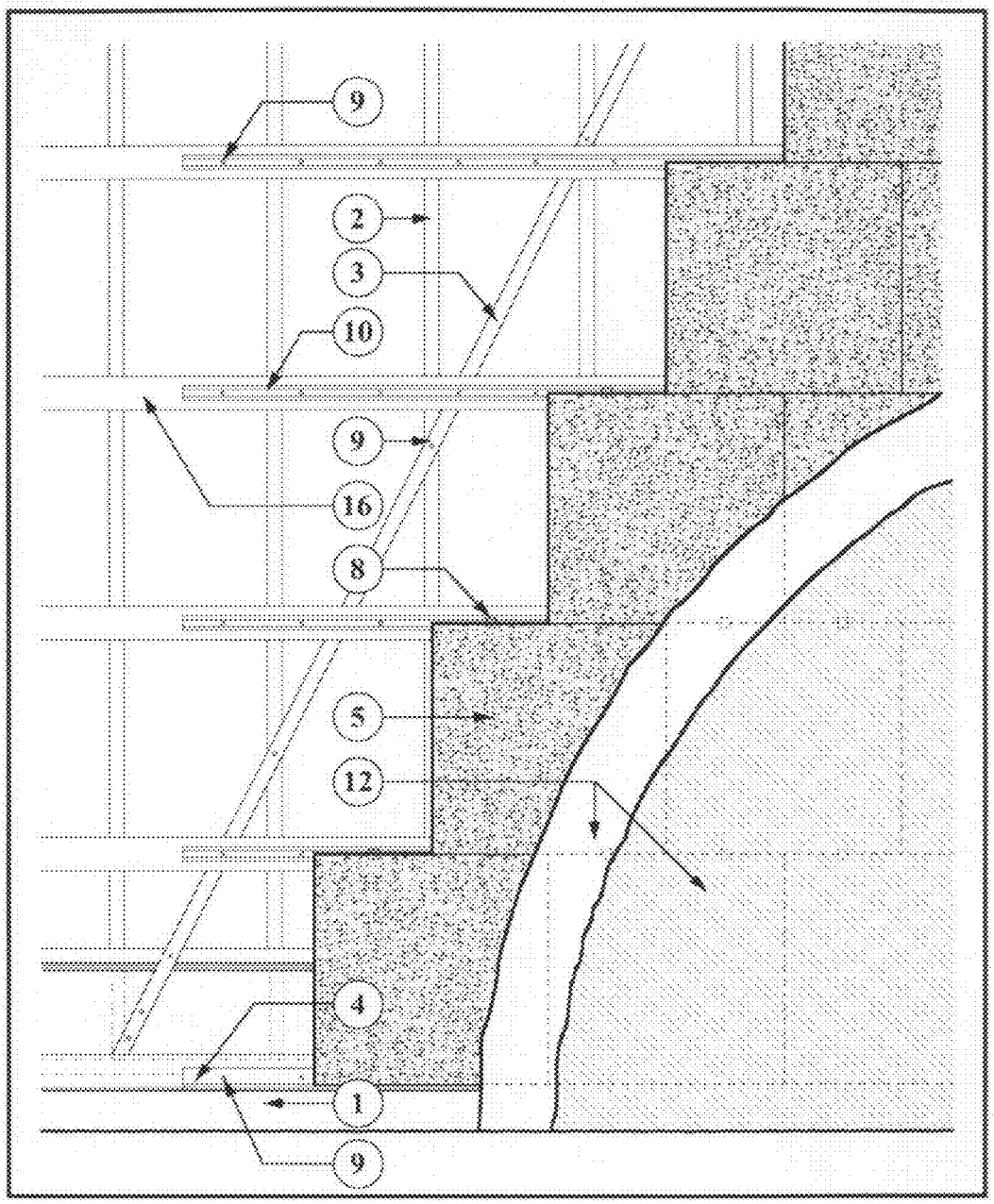
FIG. 1B illustrates a typical elevation of the wall system assembly from the exterior of the building.
Figure 1C:
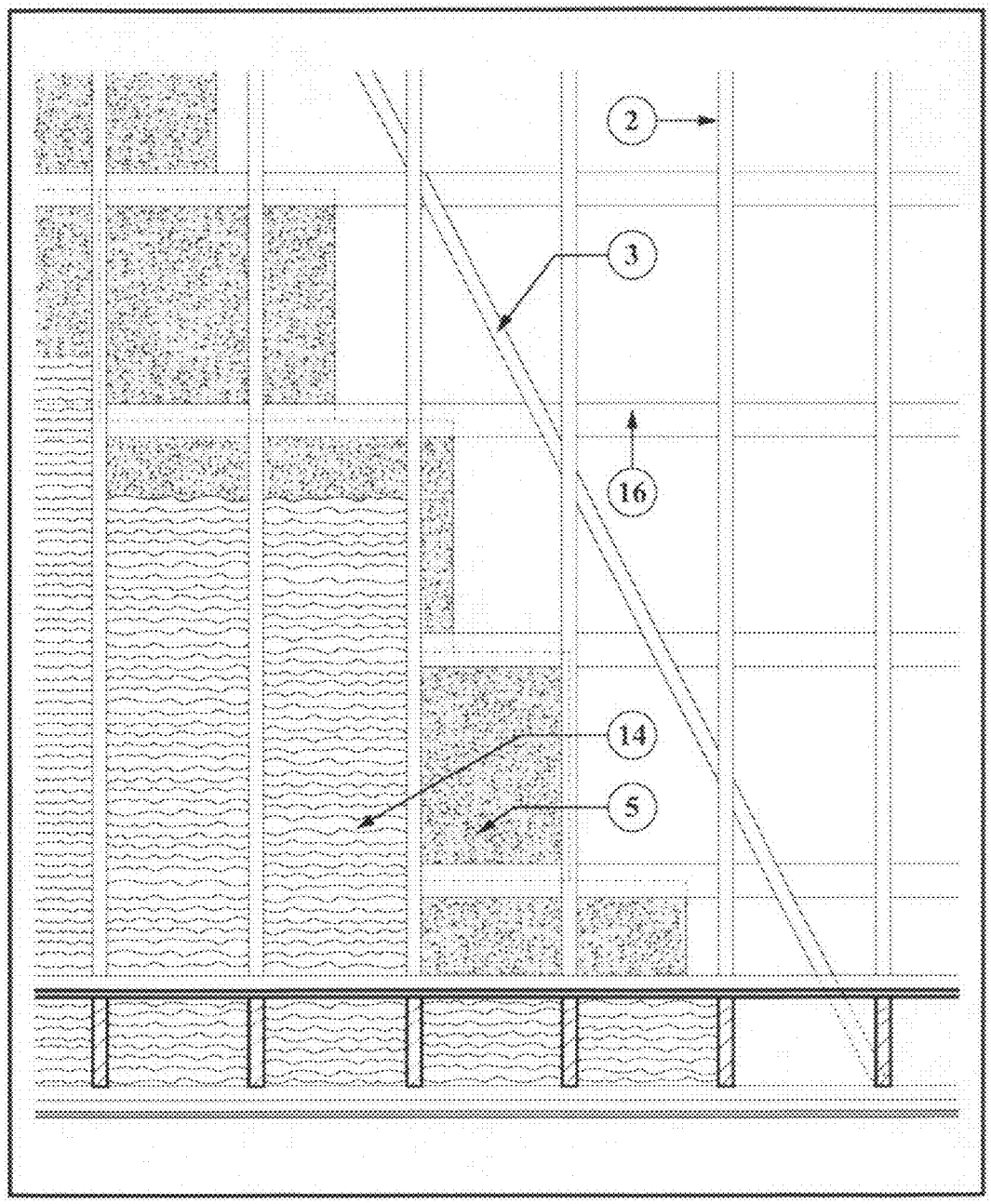
FIG. 1C illustrates a typical elevation of the wall system assembly from the interior of the building.
Figure 1D:
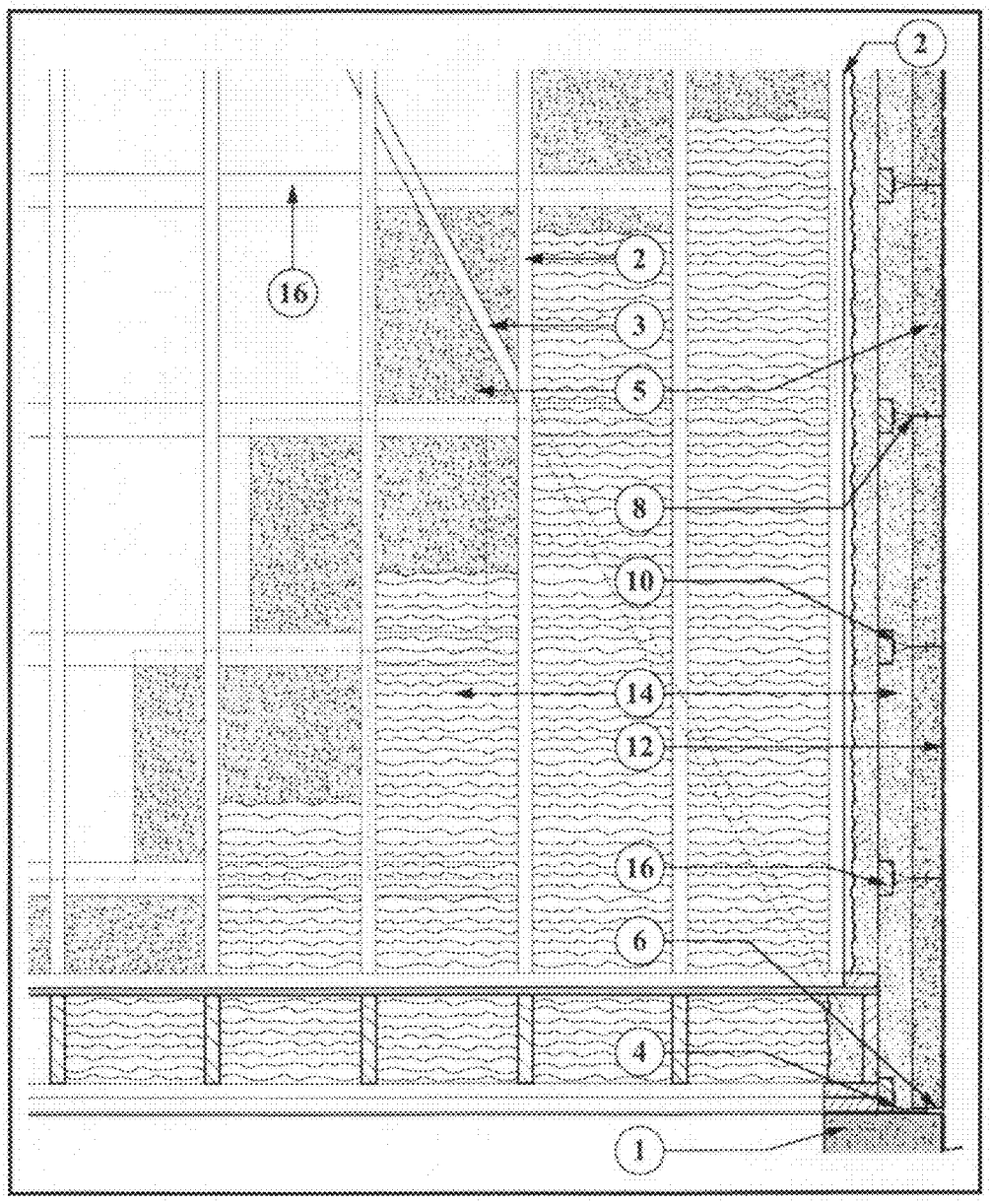
FIG. 1D illustrates a sectional elevation of the wall system assembly from the interior of the building.

In particular, FIG. 1A shows a detailed isometric view of a section of track system 10 having slidingly retained therein clip fasteners 8 with interlock stubs 8*c* and 8*d* engaging/set to engage groove(s) 7 in AAC block 5. Track section 10 is attached by attachment devices 9 (e.g., screws) to track support section 16. Track support section 16 (girt) is attached to load-bearing frame 2. Further, FIG. 1A shows a first course of AAC blocks 5 supporting a second course of AAC blocks 5 with a (leveling) layer of thin-bed mortar 6 in between the courses.

Figure 2:
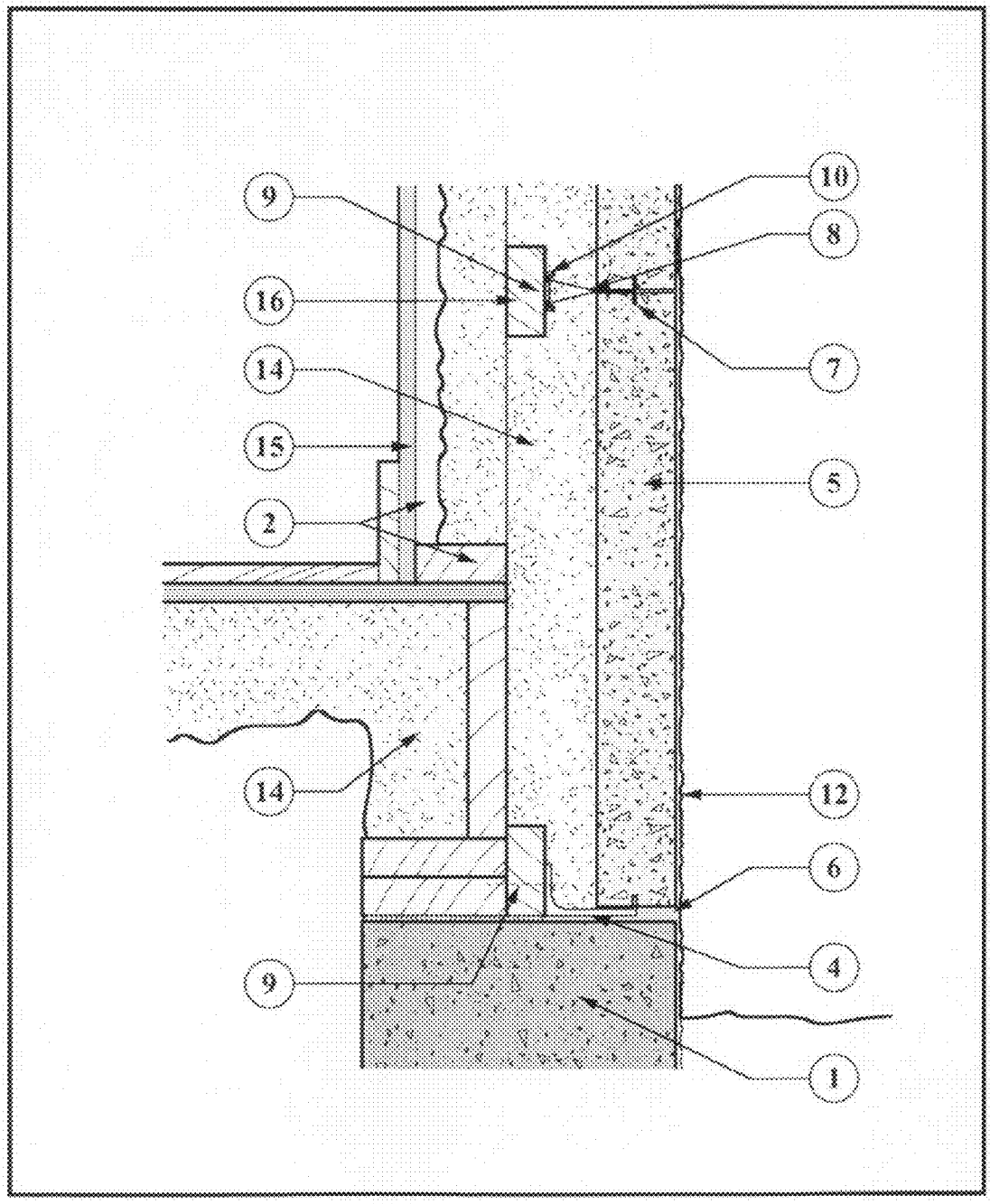
FIG. 2 illustrates a typical section of the wall system assembly at the foundation.

FIG. 2 illustrates the grade of the building surface (not numbered) exterior to the concrete foundation 1. In one embodiment of the invention, the load-bearing frame 2 may be anchored to the concrete foundation 1 through bolts (not shown) about 7" to about 9" inwards from the exterior edge of the concrete foundation 1.

The shelf angle 4 or starter piece is a continuous pultruded fiberglass shelf angle 4 that is attached 9 (e.g., screwed) to the load-bearing frame 2 at a level plane to create a level starter. Leveling grout 6 may be added underneath the shelf angles 4 at any gaps between the shelf angles 4 and the foundation 1. The shelf angles 4 have a continuous interlock stub 4*d* which fits into a bottom groove 7 of AAC blocks 5. The shelf angles 4 also comprise a vertical leg 4*c* that contains a traversing screw hole 4*b* for affixing the shelf angle 4 to the load-bearing framing system 2 using screws or bolts 9.

Shelf angle 4 is affixed continuously around the base of the load-bearing frame 2 at a level plane on top of the concrete foundation 1. The interlock stubs 4*d* of the shelf angles 4 form a level starter track. A thin-bed mortar 6 with a thickness of about 1/16" to about 1/8" or more is placed over the starter track and AAC blocks 5 are laid on the level starter track. The AAC blocks 5 each have two grooves 7 on the top and the bottom which may be approximately 1/2" deep and 1/8" wide. As the AAC block 5 is laid down onto the starter track, the interlock stubs 4*d* of the shelf angles 4 are inserted into the bottom grooves 7 of AAC blocks 5.

In another embodiment of the invention, an adhesive may be added to the grooves 7 to provide additional attachment of the AAC blocks 5 to the shelf angles and the various clip fasteners 8 disclosed in the invention.

In one embodiment of the invention, the AAC blocks are insect-proof, lightweight and insulating. In another embodiment of the invention, the AAC blocks 5 may have a thickness of from about 2" to about 6" or more, a height of from about 8" to about 24" or more and a length of from about 24" to about 48" or more, although, the present invention is not limited to particular lightweight construction units and/or AAC block dimensions. In the preferred embodiment of the invention, the AAC blocks 5 comprise a thickness of 3" and a face of 24"×24".

In particular embodiments, after the initial set of AAC blocks 5 are placed over the interlock stubs 4*d* of the shelf angles through bottom grooves 7, a plurality of track support sections 16 are horizontally (level) attached to the load-bearing framing with attachment devices 9 (e.g., screws) such that the track system sections 10 subsequently, or previously, attached thereto with attachment devices 9 (e.g., screws) are positioned to slidingly retain a plurality of clip fasteners 8 having upward projecting interlock stubs 8*c* and downward projecting interlock stubs 8*d* positioned to engage grooves 7 on one or more surfaces (e.g., top, bottom, sides, ends) of a plurality of AAC blocks 5 on a first, second, third, fourth, etc., course(s) of AAC blocks 5 during wall construction.

Figure 8:
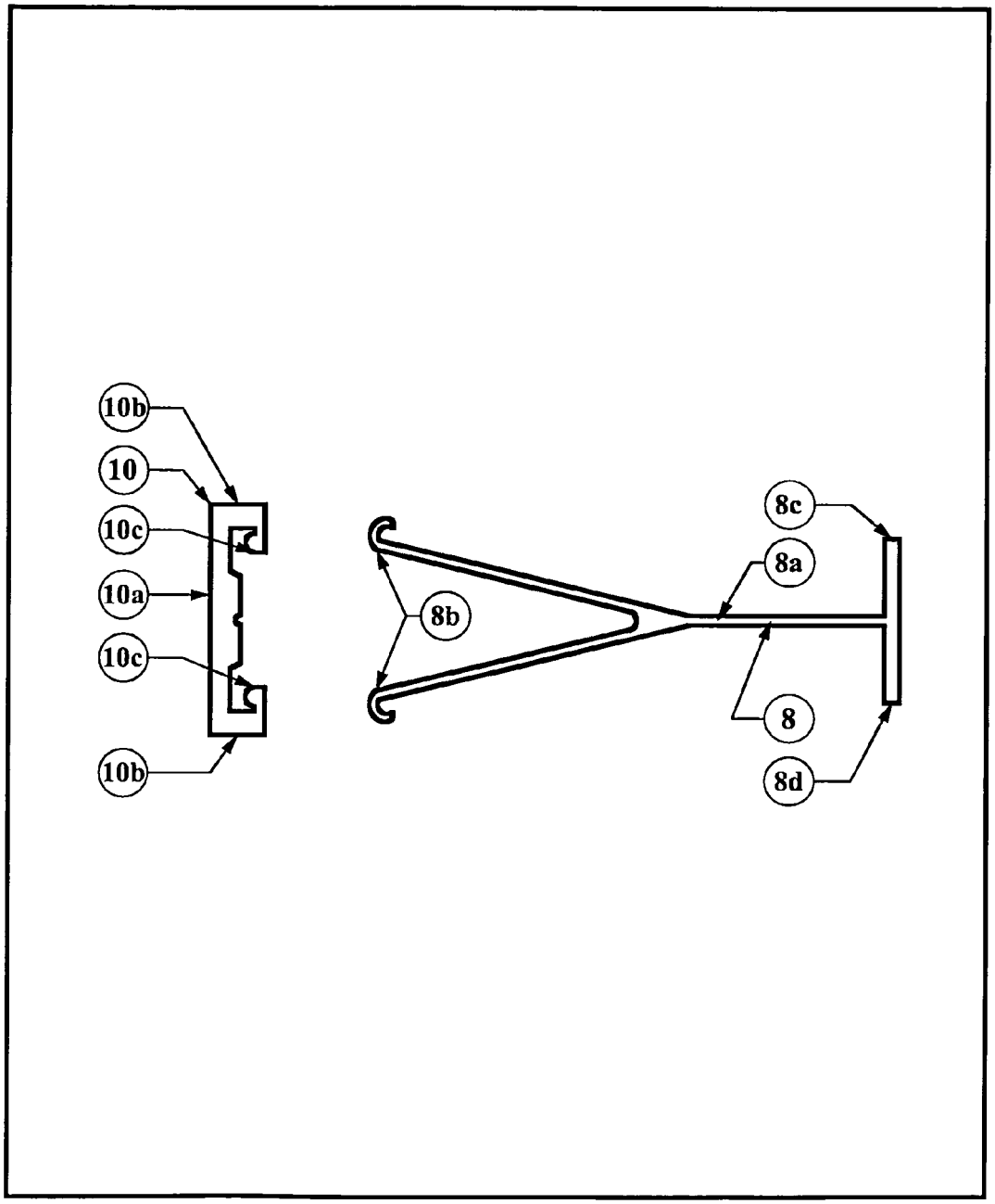
FIG. 8 illustrates cross sections of a typical track system and a clip fastener of the wall system assembly.

As illustrated in FIG. 8, clip fastener 8 comprises a main body section 8*a* that defines the horizontal axis of clip fastener 8, and four protrusions therefrom: first, sliding anchorage portion 8*b* that in turn comprises two legs in a "Y" shaped configuration emanating from main body section 8*a* of clip fastener 8; second, an upward interlock stub 8*c*; and, third, a downward interlock stub 8*d*. The sliding anchorage portion 8*b* forms a first terminus of the clip fastener 8. The upward interlock stub 8*c* and the downward interlock stub 8*d*, respectively, emanate from the main body 8*a* of clip fastener 8. The upward interlock stub 8*c* and the downward interlock stub 8*d*, respectively, forms a second terminus of clip fastener 8. Each of legs of the sliding anchorage portion 8*b* of clip fastener 8 ends in a semicircular inward curving hook shaped terminus. FIG. 8 also illustrates a cross section of a section of track system 10. Track system 10 comprises main channel body 10*a* and two perpendicular protrusions 10*b* from the main body at the respective top and bottom of track system section 10. In preferred embodiments, each of protrusions 10*b* in turn terminate in inward facing beveled (or semicircular) ridge 10*c* that is optimized to slidingly retain the mated semicircular ends of each of the legs of sliding anchorage portion 8*b* of clip fastener 8. FIG. 1A shows the semicircular ends of each of the legs of sliding anchorage portion 8*b* of clip fastener 8 accepted by and slidingly mated with the corresponding protrusions 10*b* of track system 10. Each section of track system section 10 preferably further comprise a plurality of holes (not shown) that traverse main channel body section 10*a* for receiving attachment devices 9 to thus secure the track system section 10 to the track support section 16 (girt) or secure it directly to the load-bearing fame 2.

A plurality of clip fasteners 8 are slidingly retained in track system sections 10 setting the AAC blocks 5 away from the load-bearing frame 2 by from about 1" to about 3½" or more. Downward interlock stub 8*d* is inserted into the top grooves 7 of the AAC blocks 5 and the upward interlock stub 8*c* is inserted into the bottom groove 7 of the next layer of AAC blocks 5.

In this embodiment of the invention, layers of clip fasteners 8 and AAC blocks 5 are placed on top of one another and married to the framing. In the preferred embodiment of the invention, the offset between the load-bearing frame 2 and the AAC blocks 5 is about 3½'.

In preferred embodiments, once the AAC blocks 5 have been set, the windows 13 (e.g., FIGS. 3 and 5), doors, electrical wiring and plumbing systems, and other systems and sub subsystems of the building structure may be installed.

In the present invention, the vertical cavity between the load-bearing framing 2 and the wall of AAC blocks 5 is injected with foamed-in-place medium-density closed-cell polyurethane foam 14. Because the polyurethane foam 14 is adhesive and structural, all components of the wall and wall construction system are bonded into a unified composite construction of great strength. In one embodiment of the invention, the polyurethane foam 14 may be waterproof, vapor-proof and non-toxic with high thermal resistance. In a further embodiment of the present invention, the polyurethane foam 14 may have a water-vapor permeability of less than one perm and thermal performance of about R-5 per inch or greater. Conventional finishes such as plaster may be applied to the interior of the wall 15 (See, FIG. 2).

The exterior of the AAC blocks 5 receive a cementitious stucco finish 12. In one embodiment of the present invention, the stucco finish 12 may be impact-resistant, waterproof and decorative in a variety of colors.

Figure 3:
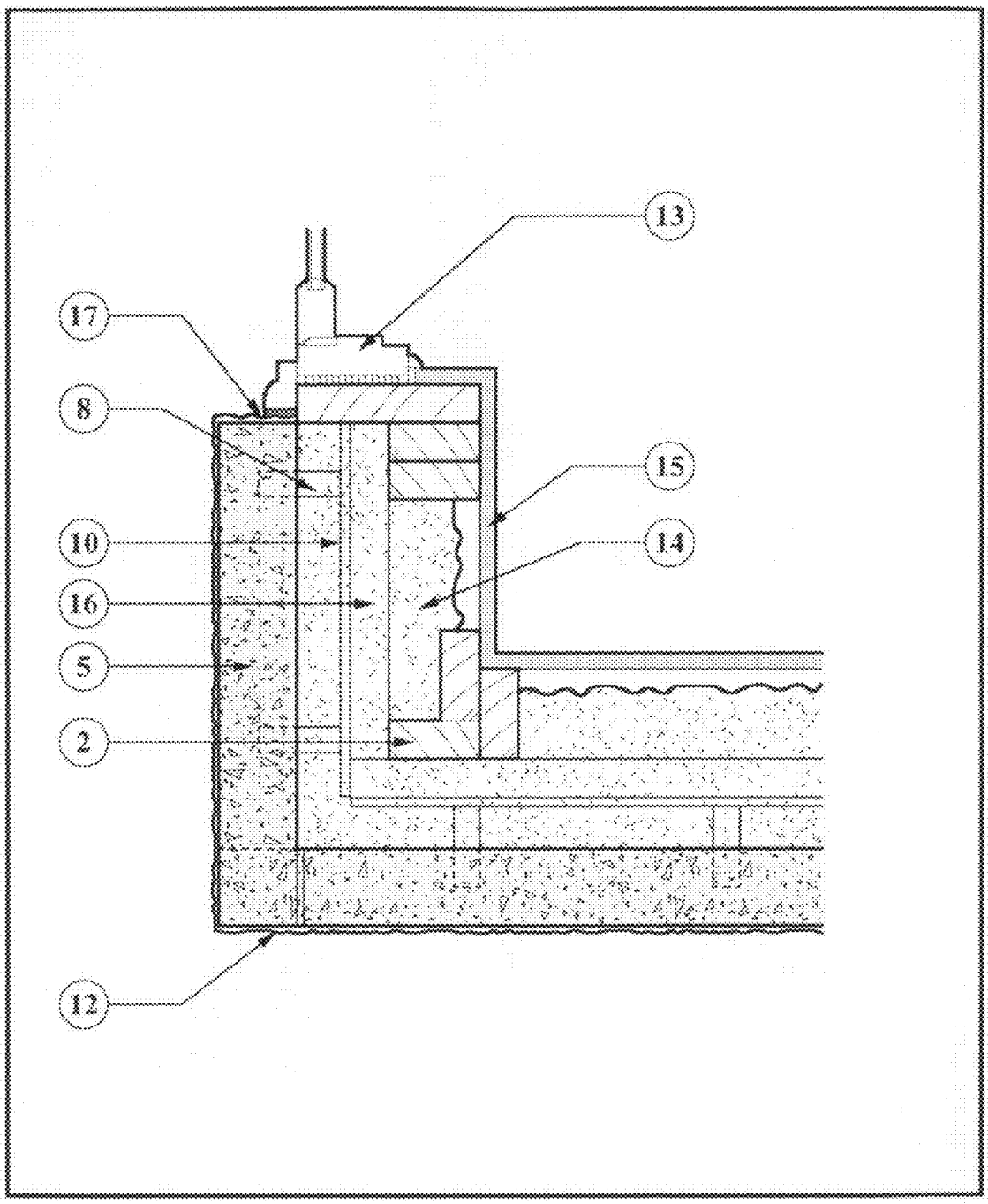
FIG. 3 illustrates a plan view of a typical section of the wall system assembly at a corner wall and window jamb.
Figure 5:
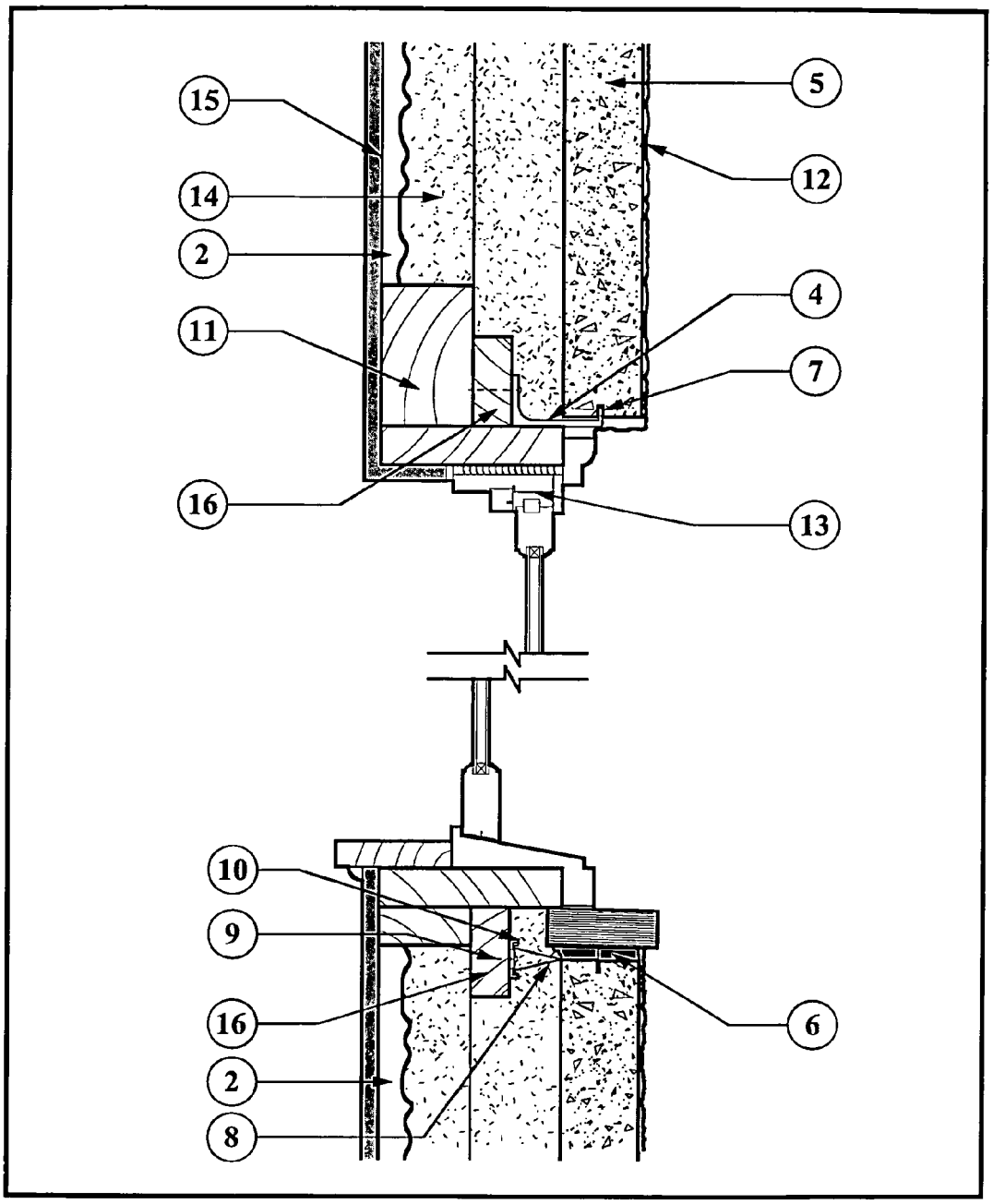
FIG. 5 illustrates a typical section of the wall system assembly at a window head and window sill.

FIG. 3 illustrates a plan view of a typical section of the wall system assembly at a corner wall and window jamb. In this embodiment, incorporation of a window 13 into the wall structure is shown. The exterior of window 13 is sealed with siliconized caulk 17. Similarly, FIG. 5 illustrates a sectional view of a typical section of the wall system assembly at a window head and sill. In this embodiment of the present invention, incorporation of a window 13 into the wall structure is shown. Lintels are created with a shelf angle 4 screwed to the lintel beam 11 of the load-bearing frame 2.

Figure 4:
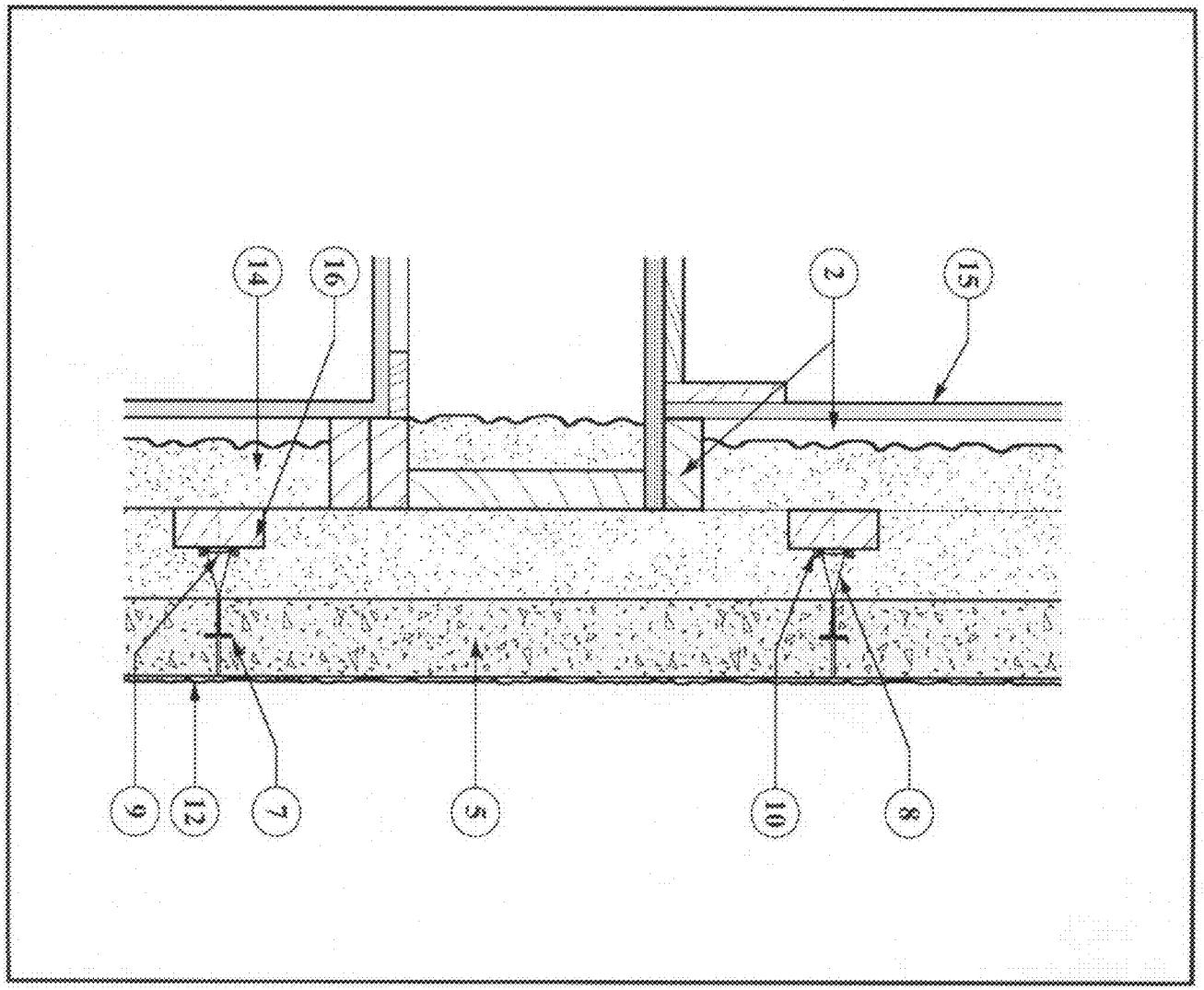
FIG. 4 illustrates a typical section of the wall system assembly at an intermediate floor.

FIG. 4 illustrates one embodiment of a sectional view at an intermediate floor of the wall system assembly. In this embodiment, a frame joist may separate the floors in the structure as known to those skilled in the art.

Figure 6:
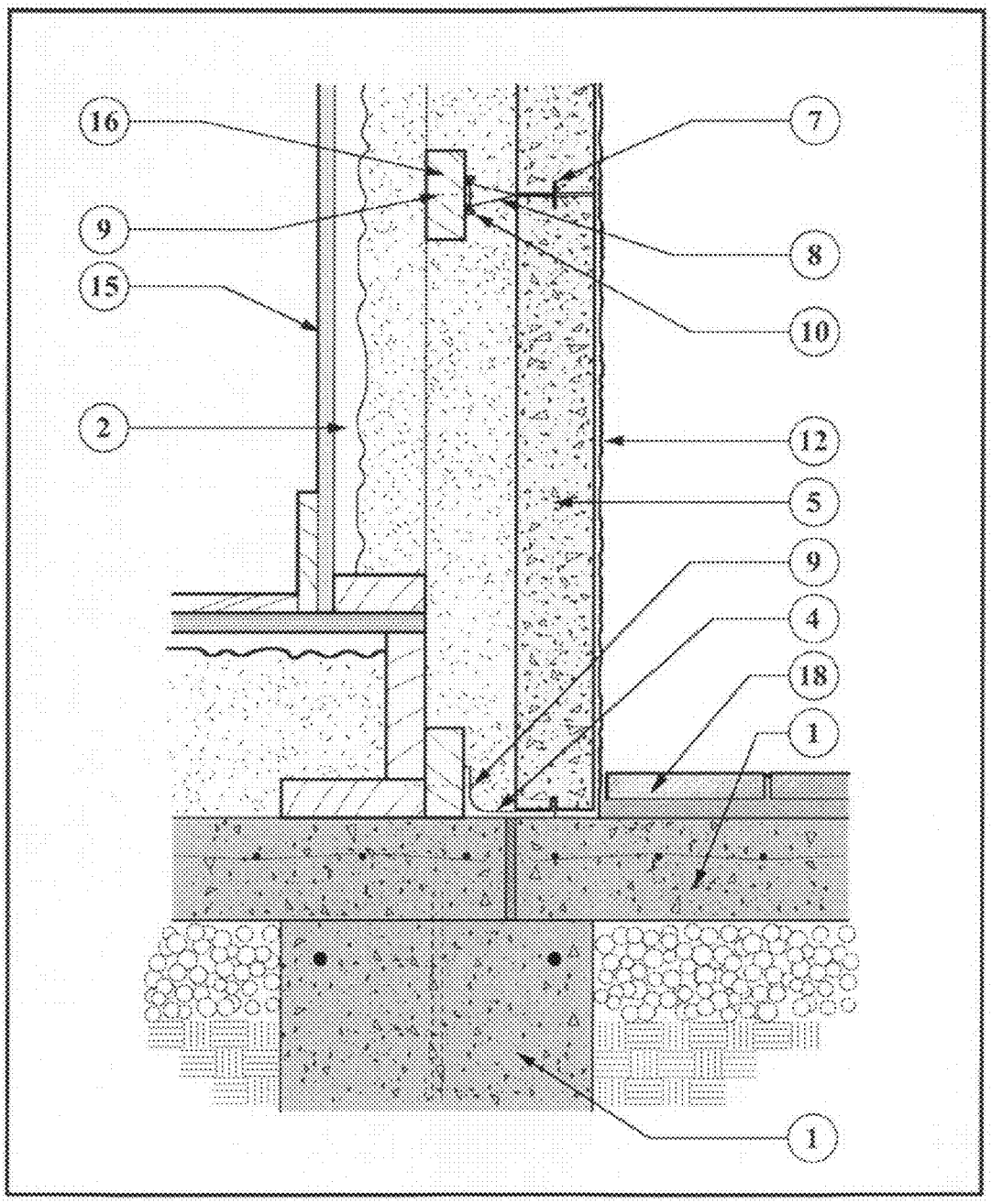
FIG. 6 illustrates a typical section of the wall system assembly at a slab foundation with exterior plaza.

FIG. 6 illustrates a section view of a typical section of the wall system assembly at a slab foundation. In this embodiment, pavers 18 are shown as part of the exterior surface treatment on the slab foundation 1.

Figure 7:
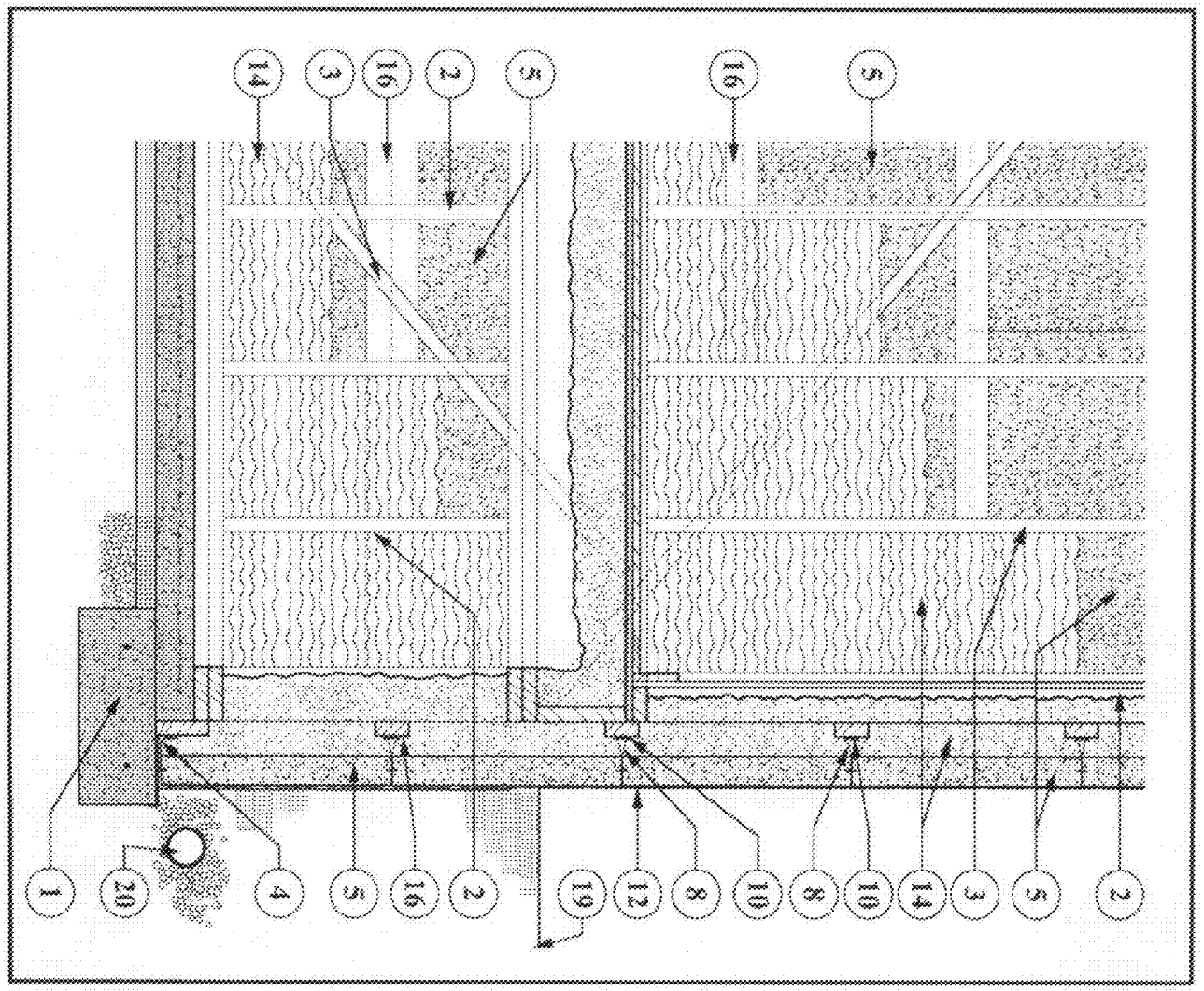
FIG. 7 illustrates a typical sectional view of the wall system assembly from the interior of the building at a stem wall.

FIG. 7 illustrates a typical sectional elevation of the wall system assembly from the interior of the building at a stem wall foundation. In this embodiment, one partial below grade 19 application of the wall construction materials and systems of the present invention is shown. In this embodiment, a drainage system 20 is optionally provided as known to those skilled in the art.

Figure 9:
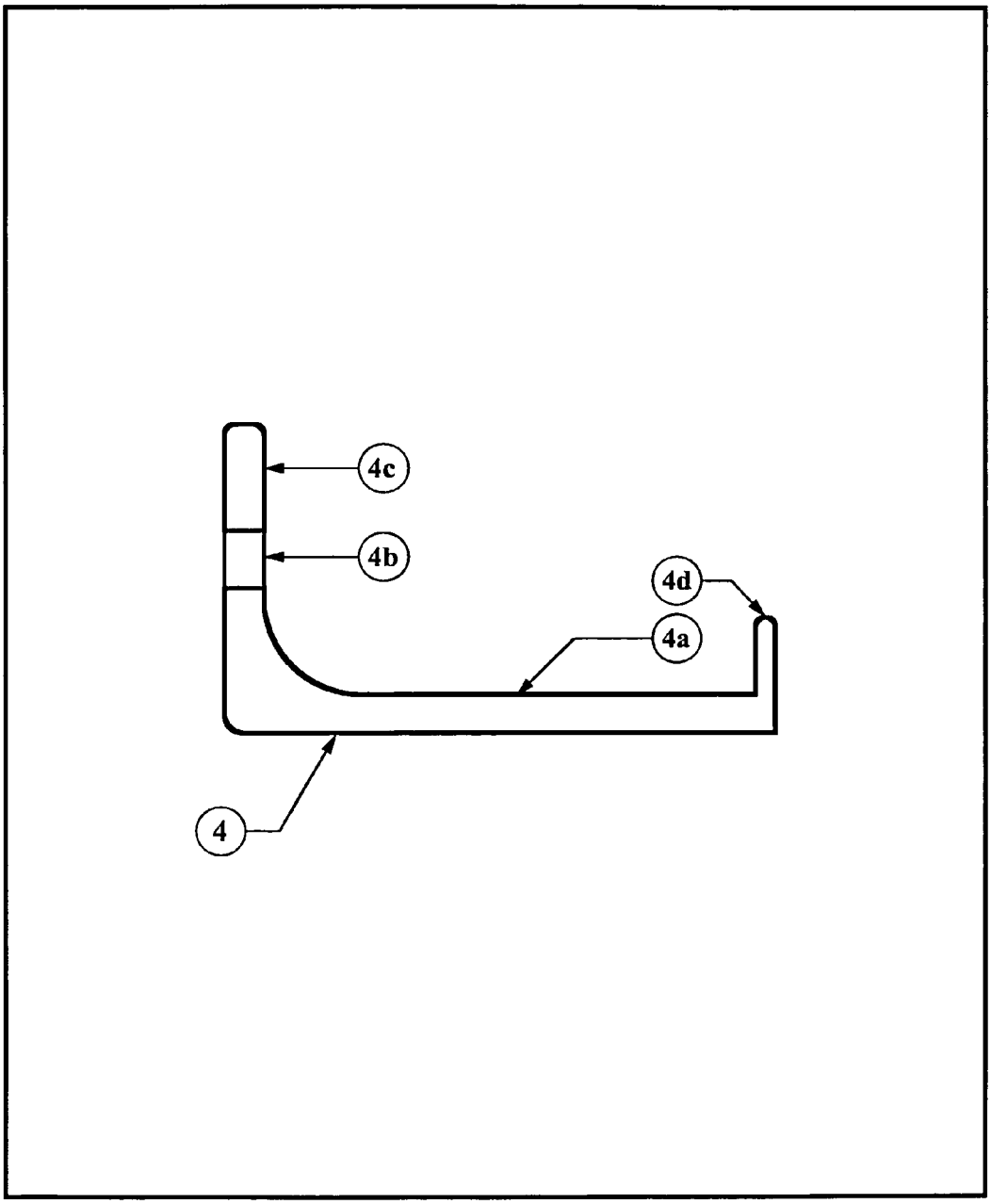
FIG. 9 illustrates a cross section of a typical shelf angle of the wall system assembly.

FIG. 9 illustrates a cross section view of the shelf angle 4 of the wall system assembly. In this embodiment, a horizontal base section 4*a* and a hole 4*b* traversing the vertical leg 4*c* for attachment by an attachment device 9 to the load-bearing frame 2 as well as the continuous interlock stub 4*d* are illustrated.

In one embodiment, the clip fasteners of the present invention may comprise lengths of 3" to 10". In another embodiment, the base surfaces of the clip fasteners of the present invention may comprise heights of ⅛" to 4" and widths of ⅛" to 4". In a further embodiment, the protrusions of the clip fasteners of the present invention may comprise heights of from about ⅛" to about 4" and widths of from about ⅛" to about 4". In one embodiment of the present invention, the resulting total wall thickness is from about 8" to about 16" or more.

The invention claimed is:

1. A composite construction system comprising: a load-bearing frame and a lightweight concrete construction unit, and a cavity between the load-bearing frame and the lightweight concrete construction unit, wherein one side of the lightweight concrete construction unit faces towards the load-bearing frame, further wherein the load-bearing frame is adhered to the lightweight concrete construction unit using at least a single layer of polyurethane foam interposed between the load-bearing frame and the lightweight concrete construction unit to fill the cavity, and at least one clip fastener, wherein the clip fastener comprises a main body section having a first terminus and second terminus, further wherein the first terminus comprises two compressible leg sections emanating from the main body section and the second terminus comprises an upward interlock stub and a downward interlock stub, the clip fastener being positioned between the load-bearing frame and the lightweight concrete construction unit such that the clip fastener is slidingly retained in the track system section.

2. The composite construction system of claim 1, wherein the load-bearing frame is made out of at least one of a group of materials consisting of solid wood, timber materials, engineered wood products, wood composite materials, steel and aluminum.

3. The composite construction system of claim 1, wherein the compressible leg sections are separated by a gap.

4. The composite construction system of claim 1, wherein each compressible leg section ends in a semicircular hook.

5. The composite construction system of claim 1, wherein the upward interlock stub and the downward interlock stub of the clip fastener, each protrude at a right angle from the main body section of the clip fastener.

6. The composite construction system of claim 1, wherein the clip fastener is made out of at least one of a group of materials comprising metals and plastics.

7. The composite construction system of claim 6, wherein the plastics comprise ABS plastics.

8. The composite construction system of claim 1, wherein the clip fastener is thermally non-conductive.

9. The composite construction system of claim 1, wherein the track system section comprises a main body having opposed top and bottom edges comprising two short protrusions at a right angles from the axis of the main body, further wherein the protrusions terminate in two opposing inwardly semicircular sections.

10. The composite construction system of claim 9, wherein the track system section is made out of at least one of a group of materials comprising metals and plastics.

11. The composite construction system of claim 10, wherein the plastics comprise ABS plastics.

12. The composite construction system of claim 1, wherein the track system section is thermally non-conductive.

13. The composite construction system of claim 1, wherein the lightweight concrete construction unit comprises an autoclaved aerated concrete (AAC) block.

14. The composite construction system of claim 13, wherein the AAC block comprises at least one groove for attaching to the clip fastener.

15. The composite construction system of claim 1, wherein the distance between the load-bearing frame and the lightweight concrete construction unit comprises about 1" to about 4".

16. The composite construction system of claim 1, wherein the single layer of polyurethane foam comprises a width of about 2" to about 8".

17. A method for constructing a wall of a building, comprising the steps of:

a) erecting a load-bearing frame having an interior facing surface and an exterior facing surface on a support such as a conventional foundation or slab;

b) placing at least one shelf angle on top of the foundation on the exterior surface of the load-bearing frame, wherein the shelf angle comprises an upwardly projecting interlock stub, further wherein the shelf angle is placed such that the interlock stub extends in an upward direction from the foundation distal from the load-bearing frame;

c) placing a first lightweight concrete construction unit having a top groove and a bottom groove on top of the shelf angle by inserting the interlock stub of the shelf angle into the bottom groove of the lightweight concrete construction unit, such that a cavity is created between the load-bearing frame and the lightweight concrete construction unit, further wherein the lightweight concrete construction unit has an interior facing surface facing the load-bearing frame and an opposite exterior facing surface and a top facing surface and an opposite bottom facing surface;

d) attaching at least one track support section to the exterior surface of the load-bearing frame;

e) attaching at least one track system section to the track support section;

f) providing at least one clip fastener, wherein the clip fastener comprises a main body section having a first terminus and second terminus, and further wherein the first terminus comprises two compressible leg sections emanating from the main body section and the second terminus comprises a downward interlock stub and an upward interlock stub;

g) compressing the leg sections of the clip fastener to compressively insert the first terminus of the clip fastener into the track system section such that the clip fastener is slidingly retained in the track system section, wherein the clip fastener is placed such that the downward interlock stub is inserted into the top groove of the first lightweight concrete construction unit;

h) applying a layer of adhesive to the top surface of the lightweight concrete construction unit;

i) placing a second lightweight concrete construction unit on top of the first lightweight concrete construction unit such that the top interlock stub of the clip fastener is inserted into the bottom groove of the second lightweight concrete construction unit;

j) repeating steps (d) through (i) until a desired exterior wall height and cavity separating the lightweight concrete construction units and the load-bearing frame are achieved; and k) injecting a polyurethane foam into the cavity.

18. The method for constructing a wall of a building of claim 17, wherein the compressible leg sections of the clip fastener are separated by a gap.

19. The method for constructing a wall of a building of claim 17, wherein each compressible leg section ends in a semicircular hook.

20. The method for constructing a wall of a building of claim 17, wherein the upward interlock stub and the downward interlock stub of the clip fastener, each protrude at a right angle from the main body section of the clip fastener.

* * * * *